United States Patent [19]

Schmidt

[11] Patent Number: 4,526,345

[45] Date of Patent: Jul. 2, 1985

[54] DOUBLE LIFT JACK

[75] Inventor: George S. Schmidt, Schenectady, N.Y.

[73] Assignee: General Electric Company, Schenectady, N.Y.

[21] Appl. No.: 610,451

[22] Filed: May 15, 1984

[51] Int. Cl.[3] ..... B66F 3/22

[52] U.S. Cl. ..... 254/93 R

[58] Field of Search ..... 187/8.43; 92/53; 254/2 B, 93 H, 93 R, 89 H, 90

[56] References Cited

U.S. PATENT DOCUMENTS

| | | | |
|---|---|---|---|
| 3,048,237 | 8/1962 | Rutherford | 187/8.43 |
| 3,365,026 | 1/1968 | Mancini | 187/8.43 |
| 4,447,042 | 5/1984 | Masui | 254/90 |

FOREIGN PATENT DOCUMENTS

| | | | |
|---|---|---|---|
| 2746610 | 4/1978 | Fed. Rep. of Germany | 254/93 H |

*Primary Examiner*—Robert C. Watson
*Attorney, Agent, or Firm*—Robert A. Cahill

[57] ABSTRACT

A double lift jack employs a first hydraulic jack having a long, high-speed lift to elevate a platant into an operating position and a second hydraulic jack mounted on the platant having a short, low-speed lift. The two jacks and the platant are mounted in a sturdy, open-topped housing. The long-lift jack is employed to rapidly elevate the platant and the short-lift jack into their operating positions. The platant is thereupon affixed to the housing in the extended position using studs which are passed through a lip on the housing as the platant is elevated. A load base is raised and lowered by operation of the short-lift jack. The load base is stabilized by hardened guide rods which pass through guide holes in the platant. The thus-locked platant provides a stable base and precise guidance for positioning of a load mounted on the load base. When the studs are released, and the long-lift jack is retracted, the load base is rapidly cleared from interference with a load. A hydraulic control system for the two jacks requires that the long-lift jack receive pressurized hydraulic fluid before permitting actuation of the short-lift jack in order to ensure that the platant is urged into its secured position in contact with the lip of the housing whenever the load base is raised or lowered.

11 Claims, 3 Drawing Figures

DOUBLE LIFT JACK

BACKGROUND OF THE INVENTION

The present invention relates to lifting equipment and, more particularly, to hydraulic jacks requiring a combination of high-speed operation over a large lifting range and high stability within a limited lifting range.

Hydraulic jacks are conventionally employed for raising loads under the influence of hydraulic pressure introduced into a hydraulic cylinder. The hydraulic pressure acts upon a piston slideably fitted within the hydraulic cylinder to force the piston outward and to thereby apply a force to an external object.

The distance through which a hydraulic jack is capable of moving its piston is limited primarily by the length of its cylinder. Hydraulic cylinders having a piston travel exceeding 100 feet are in routine use. The external force which a hydraulic jack can exert is equal to the area of its piston times the hydraulic pressure to which the piston is exposed.

As the distance through which a hydraulic piston must be moved becomes larger, it becomes more difficult to achieve high rigidity in supporting a load. In prior U.S. patent application Ser. No. 491,509, the disclosure of which is herein incorporated by reference and of which I am a co-inventor, a method is disclosed for unstacking shrunk-fit turbine wheels from a turbine shaft. In brief, the method employs an electric oven which can be installed, on site, about a turbine wheel to be removed while the shaft thereof is in a horizontal position. The oven is capable of injecting heat into the turbine wheel at a rate fast enough to expand the hub of the turbine wheel to the point that a clearance is developed in the shrunk-fit interface between the hub and the shaft before the shaft can expand sufficiently to eliminate the clearance. The referenced application also discloses a handling trolley which rapidly and accurately moves the released turbine wheel axially horizontally along the shaft until the hub is clear of the shrink-fit area. A similar but reverse procedure is employed in restacking the turbine wheels on the shaft.

In the disclosed referenced method, the turbine shaft is supported on fixed stands with its axis horizontally disposed. During the stacking and unstacking process, the fixed stands must be moved to different positions along the rotor. To permit moving the fixed stands, a jack is used to raise and support one end of the turbine rotor while a fixed stand is removed and repositioned. A substantial jack capacity is required to accurately handle a turbine rotor which may weigh, for example, in excess of 200 tons. At certain times it is desirable to combine the large jack capacity with high positioning precision over a small range of movement and, at other times, high speed with low precision over a large range of movement is desired. In addition, it is highly desirable that the jack be capable of stable support of the shaft for extended periods of time with enough rigidity that servicing operations such as, for example, machining of the shaft or attached elements, may be performed with the shaft supported by a bearing borne by the jack.

OBJECTS AND SUMMARY OF THE INVENTION

Accordingly, it is an object of the invention to provide a hydraulic jack which overcomes the drawbacks of the prior art.

It is a further object of the invention to provide a double lift hydraulic jack having a first hydraulic actuator effective for moving a platant through a substantial distance and a second hydraulic actuator on the platant effective for moving a load through a different distance at high precision. A mechanical coupling between the platant and a housing of the jack permits locking the platant in its operating position.

Briefly stated, the present invention provides a double lift jack which employs a first hydraulic jack having a long, high-speed lift to elevate a platant into an operating position and a second hydraulic jack mounted on the platant having a short, low-speed lift. The two jacks and the platant are mounted in a sturdy, open-topped housing. The long-lift jack is employed to rapidly elevate the platant and the short-lift jack into their operating positions. The platant is thereupon affixed to the housing in the extended position using studs which are passed through a lip on the housing as the platant is elevated. A load base is raised and lowered by operation of the short-lift jack. The load base is stabilized by hardened guide rods which pass through guide holes in the platant. The thus-locked platant provides a stable base and precise guidance for positioning of a load mounted on the load base. When the studs are released, and the long-lift jack is retracted, the load base is rapidly cleared from interference with a load. A hydraulic control system for the two jacks requires that the long-lift jack receive pressurized hydraulic fluid before permitting actuation of the short-lift jack, in either direction, in order to ensure that the platant is urged into its secured position in contact with the lip of the housing whenever the load base is raised or lowered.

According to an embodiment of the invention, there is provided a double lift jack comprising a housing. the housing including a base supportable on a surface and at least one rigid vertical member extending upward from the base, a first hydraulic jack disposed on the base, the first hydraulic jack including means responsive to an application of a first pressurized hydraulic fluid thereto for producing a first vertical urging, a platant in the housing, means in the housing for permitting a first vertical motion of the platant in response to the first vertical urging between a first vertical position and a second vertical position, a second hydraulic jack disposed on the platant, a load base mounted on the second hydraulic jack, the second hydraulic jack including means responsive to an application of a second pressurized hydraulic fluid thereto for producing a second vertical urging, means in the platant for permitting a second vertical motion of the load base in response to the second vertical urging and means for rigidly mechanically affixing the platant to the at least one rigid vertical member in at least one of the first and second vertical positions whereby the platant is stabilized by the at least one rigid vertical member in the at least one of the first and second positions and a precision and stability of the second vertical motion is improved independently of a precision and stability of the first hydraulic jack.

According to a feature of the invention, there is provided a double lift jack system comprising a housing, said housing including a base supportable on a surface and at least one rigid vertical member extending upward from said base, a first hydraulic jack disposed on said base, said first hydraulic jack including means responsive to an application of a first pressurized hydraulic fluid thereto for producing a first vertical urging, a platant in said housing, means in said housing for permitting a first vertical motion of said platant in response to said first vertical urging between a first vertical position and a second vertical position, a second hydraulic jack disposed on said platant, a load base mounted on said second hydraulic jack, said second hydraulic jack including means responsive to an application of a second pressurized hydraulic fluid thereto for producing a second vertical urging, means in said platant for permitting a second vertical motion of said load base in response to said second vertical urging, means for rigidly mechanically affixing said platant to said at least one rigid vertical member in at least one of said first and second vertical positions whereby said platant is stabilized by said at least one rigid vertical member in said at least one of said first and second positions and a precision and stability of said second vertical motion is improved independently of a precision and stability of said first hydraulic jack and hydraulic control apparatus for controlling application of said first pressurized hydraulic fluid and said second pressurized hydraulic fluid.

The above, and other objects, features and advantages of the present invention will become apparent from the following description read in conjunction with the accompanying drawings, in which like reference numerals designate the same elements.

BRIEF DESCRIPTION 0F THE DRAWINGS

DETAILED DESCRIPTION OF THE PREFERRED EMBODIMENT

Although a double lift hydraulic jack according to the present invention may be used in any suitable application, for concreteness of description it is described in the context of a system for servicing turbine wheels. It should be understood, however, that I have no intention that my invention should be limited to such an application.

Figure 1:
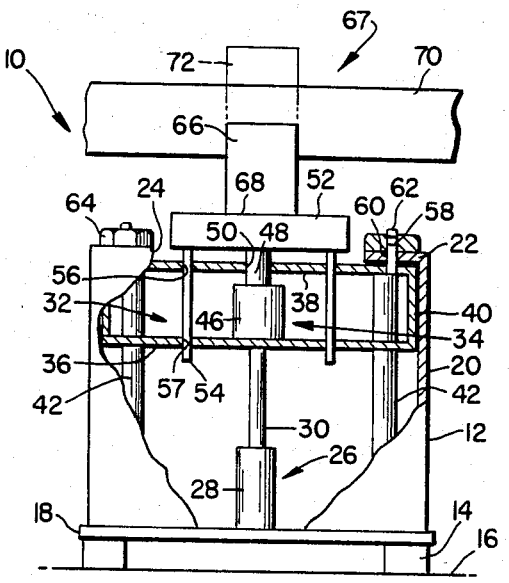
FIG. 1 is a side view of a double lift jack according to an embodiment of the invention in partial cross section in its operating condition supporting and/or raising a load.

Referring first to FIG. 1, there is shown, generally at 10, a double lift jack according to an embodiment of the invention. A housing 12 rests on a plurality of feet 14 on a supporting surface 16. Housing 12 includes a base plate 18 resting on feet 14. Four side walls 20 extend upward from base plate 18 to an overhanging lip 22. A rectangular opening 24 is formed by overhanging lip 22 for purposes to be described hereinafter. Housing 12 is thus seen to resemble a box with a closed bottom and an open top.

Conventional means are preferably provided for permitting double lift jack 10 to be moved about on supporting surface 16. Any suitable means for permitting such motion of double lift jack 10 may be employed such as, for example, an air pallet (not shown). In addition, at least some of feet 14 preferably include conventional height-adjustment devices such as, for example, height-adjustment screws (not shown) for accommodating an unevenness of supporting surface 16.

The simple box structure of housing 12 shown in FIG. 1 is for purposes of illustration. In different applications, different amounts of strength are required in housing 12. In applications in which the simple box structure does not provide sufficient strength, additional well-known conventional strength elements such as, for example, corner posts and double thicknesses of bar stock (neither of which is shown) may be employed. Instead of the closed structure illustrated, housing 12 may alternately be made of suitable open beams using, for example, I beams (not shown). One skilled in the art would be fully familiar with the manner in which such strength requirements may be calculated and the elements required to provide it may be specified. Such additional items are therefore omitted herefrom to avoid needless clutter of the disclosure.

A long-lift hydraulic jack 26 is disposed within housing 12 generally centered upon base plate 18. Long-lift hydraulic jack 26 includes a hydraulic piston 28 having one end mounted on base plate 18 and a piston rod 30 extending generally vertically therefrom. A platant 32 is mounted at a distal end of piston rod 30. Platant 32 is herein defined as an element which is itself subject to urging of long-lift hydraulic jack 26 and, in addition, bears a short-lift hydraulic jack 34 which is controllable to apply a force to a load. Platant 32 includes a lower plate 36, against which piston rod 30 abuts, and an upper plate 38. A plurality of vertical plates 40, only two of which are shown, join lower plate 36 and upper plate 38 to form a rigid structure capable of supporting a load placed upon it with no more than negligible distortion.

A guide rail, or guide rod, 42 is vertically disposed within housing 12 at each side of platant 32 between base plate 18 and overhanging lip 22. Platant 32 includes slideable guiding means (not shown) such as, for example, circular openings slideably fittable about guide rods 42 to provide a relatively coarse measure of guidance to platant 32 during vertical travel thereof.

Short-lift hydraulic jack 34, disposed within platant 32, includes a hydraulic cylinder 46 centrally positioned on lower plate 36 and a piston rod 48 extending upward from hydraulic cylinder 46 through an opening 50 in upper plate 38. An upper end of piston rod 48 engages the bottom of a bearing base 52. Four hardened guide rods 54 (only two of which are shown) extend downward through aligned, closely fitting guide holes 56 in upper plate 38 and guide holes 57 in lower plate 36. The combination of guide rods 54, guide holes 56 and guide holes 57 is effective to precisely and stably guide vertical motion of bearing base 52 with respect to platant 32.

Four studs 58 (only two of which are shown) are rigidly affixed to platant 32 and are positioned to pass vertically through mating holes 60 in overhanging lip 22. An outer end 62 of each stud 58 is threaded to receive a threaded nut 64 on the upper side of overhanging lip 22. It will be recognized that, when platant 32 is elevated to its uppermost position shown, and when threaded nuts 64 are installed on outer ends 62 of stud 58, platant 32 is rigidly affixed to housing 12 and is no longer subject to instabilities of long-lift hydraulic jack 26 or of the intermediate guidance provided by guide rod 42.

A lower bearing half 66, shown in solid line, of a bearing 67, is disposed on an upper surface 68 of bearing base 52. A load such as, for example, a cylindrical shaft 70, is cradled in lower bearing half 66. For many operations in the method of the referenced patent application where only precise lifting and/or support of cylindrical shaft 70 is required, only lower bearing half 66 is necessary. When machining or other operations requiring even more precise retention of cylindrical shaft 70 are to be performed on cylindrical shaft 70 or on elements attached to it (especially operations requiring turning of cylindrical shaft 70), an upper bearing half 72 of bearing 67, shown in dashed line, may be installed about cylindrical shaft 70 atop lower bearing half 66. Any convenient type of bearing may be used in lower bearing half 66 including, for example, conventional fixed journal bearings. However, in the preferred embodiment, I have discovered that a pivoting-shoe hydrostatic bearing provides greater positioning tolerance for positioning cylindrical shaft 70 on lower bearing half 66 and thereby reduces the time and difficulty attendant upon achieving the supporting position shown in FIG. 1. Since bearings, including pivoting-shoe hydrostatic bearings, are conventional and well known to one skilled in the art, a full discussion thereof is omitted herefrom.

In order to achieve the desired level of stability and control of cylindrical shaft 70, the length of travel of short-lift hydraulic jack 34 is necessarily kept short and its actuation speed is kept low. For example, I have discovered that a total length of travel on the order of six inches is appropriate. Normally, piston rod 48 is set within the center of its range and thus provides a travel range of about plus and minus three inches. The diameter of cylindrical shaft 70 may be on the order of 24 inches. Thus, when lower bearing half 66 cradles a lower cylindrical half of cylindrical shaft 70, lower bearing half 66 must be lowered at least 12 inches to clear cylindrical shaft 70 and to thus permit double lift jack 10 to be moved into place under cylindrical shaft 70 or to be removed therefrom. The vertical travel of short-lift hydraulic jack 34 is too small, by itself, to clear cylindrical shaft 70. In addition, when used in the turbine wheel unstacking method of the referenced patent application, the time consumed in lowering and removing lower bearing half 66 may be of the essence. The low speed purposely provided for short-lift hydraulic jack 34 may take too long to clear cylindrical shaft 70, even if the above problem of insufficient travel range could be solved.

Figure 2:
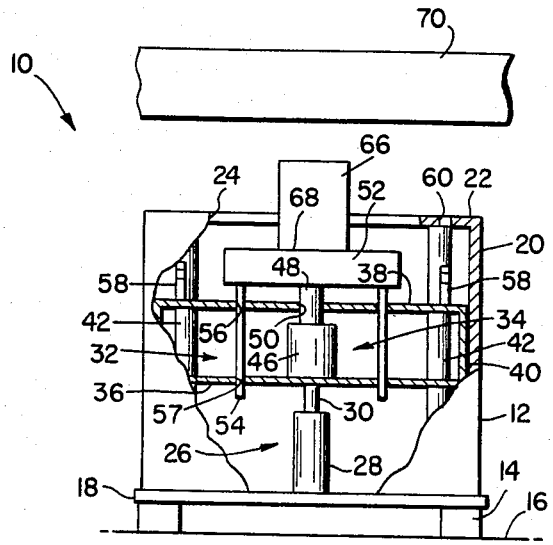
FIG. 2 is a side view of the double lift jack of FIG. 1 in its retracted position.

Referring now to FIG. 2, double lift jack 10 is shown with platant 32 retracted into housing 12 by the retraction of piston rod 30 into hydraulic piston 28. For present purposes, it is assumed that cylindrical shaft 70 is supported on an external device such as, for example, a fixed stand (not shown) which is not of concern to the present invention. Threaded nuts 64 (see FIG. 1) are, of course, removed from studs 58 to permit platant 32 to be lowered. Bearing base 52 and lower bearing half 66 are drawn downward within housing 12 through rectangular opening 24 to thereby lower the top of lower bearing half 66 clear of cylindrical shaft 70. Since great precision is not required during the lowering of platant 32, long-lift hydraulic jack 26 moves as rapidly as is convenient.

In raising platant 32 from the retracted position in FIG. 2 to the extended position in FIG. 1, the guidance provided by guide rods 42 need only be sufficient to ensure that studs 58 enter their mating holes 60. This entry may be aided by appropriate chamfering on studs 58 and/or tapering or counterboring of entry portions of holes 60. When platant 32 attains the fully raised position, with outer ends 62 extending through their respective holes 60, threaded nuts 64 may again be installed to lock platant 32 in this position.

FIGS. 1 and 2 illustrate an embodiment of the invention having a single platant 32 and a single short-lift hydraulic jack 34. It would be clear to one skilled in the art that more than one hydraulic jack could be used in either of these locations for increasing the load-handling capability or for increasing the horizontal area over which the load may be spread. In fact, the preferred embodiment of the invention employs two hydraulic jacks for long-lift hydraulic jack 26 and also employs two hydraulic jacks for short-lift hydraulic jack 34. The second hydraulic jack is, in each case, positioned on the center line behind the one illustrated and is therefore not visible in the figures.

For long term support of cylindrical shaft 70, suitable mechanical blocking may be installed between the bottom of bearing base 52 and the top of upper plate 38. Such mechanical blocking may consist of, for example, one or more pairs of opposed wedges (not shown) which can be adjusted to fit the vertical space and to thereby bear the load. When such mechanical blocking is in place, the pressure applied to short-lift hydraulic jack 34 may be released if desired.

Figure 3:
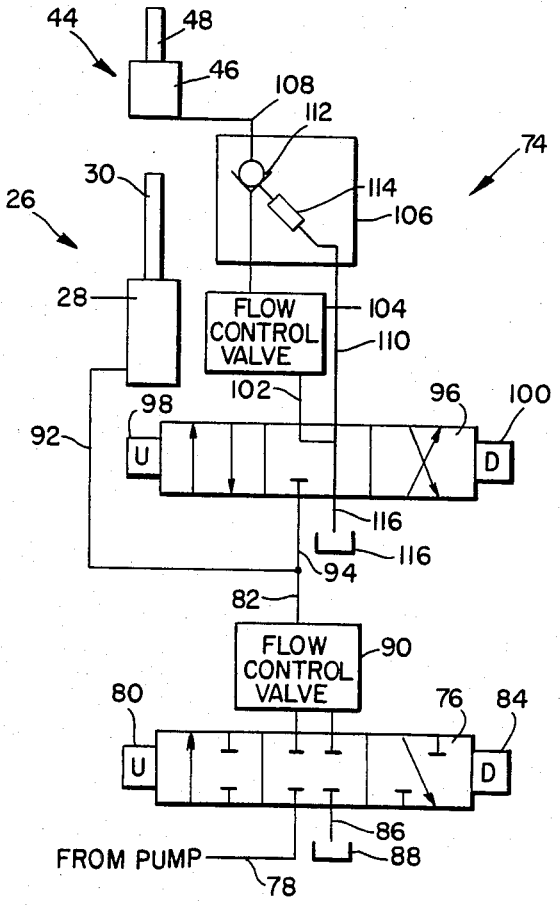
FIG. 3 is a schematic diagram of a hydraulic control system suitable for use in the embodiment of the invention shown in FIGS. 1 and 2.

Referring now to FIG. 3, there is shown, generally at 74, a hydraulic control system suitable for use with the present invention. To summarize the operation of hydraulic control system 74, actuation of short-lift hydraulic jack 34, either raising or lowering, requires that long-lift hydraulic jack 26 be urged into its fully extended position. This ensures that, when a lifting or lowering operation is being performed with short-lift hydraulic jack 34, long-lift hydraulic jack 26 is simultaneously actuated to urge platant 32 into full contact with an underside of overhanging lip 22. This reinforces the stability offered by studs 58.

A long-lift jack control valve 76 receives a supply of pressurized hydraulic fluid on a hydraulic line 78 from a hydraulic pump (not shown). Long-lift jack control valve 76 may be of any convenient type including manually operated or solenoid operated types. In the preferred embodiment, long-lift jack control valve 76 is a solenoid operated valve responsive to an electrical signal applied to an up solenoid 80 for valving the pressurized hydraulic fluid from hydraulic line 78 to an output line 82, and to a down solenoid 84 for venting pressurized hydraulic fluid from output line 82 through a discharge line 86 into a sump 88.

A conventional flow control valve 90 is interposed in output line 82. Flow control valve 90 is preferably of a type which permits full forward flow and limits the amount of reverse flow to a predetermined value. The limitation of reverse flow may be achieved, for example, by a forward check valve and a flow-limiting orifice (not shown) in flow control valve 90.

Hydraulic fluid on a downstream side of flow control valve 90 splits into a first hydraulic line 92 passing directly to hydraulic piston 28 of long-lift hydraulic jack 26 and a second hydraulic line 94 connected to a short-lift jack control valve 96. Short-lift jack control valve 96 may also be of any convenient type but, in the preferred embodiment, is a solenoid-controlled valve controlled by electrical signals to an up solenoid 98 and a down solenoid 100. A fluid supply and discharge line 102 receives pressurized hydraulic fluid from, and returns vented hydraulic fluid to short-lift jack control valve 96. A flow control valve 104 is connected in fluid supply and discharge line 102 between short-lift jack control valve 96 and a pilot-operated control valve 106. A hydraulic line 108 between pilot-operated control valve 106 and hydraulic cylinder 46 provides pressurized hydraulic fluid to, and receives discharged hydraulic fluid from, hydraulic cylinder 46 of short-lift hydraulic jack 34.

Flow control valve 104 is preferably of a type which permits full flow in the forward direction, but limits reverse flow to a predetermined value in order to accurately control the rate at which short-lift hydraulic jack 34 may be lowered. Most preferably, flow control valve 104 is a conventional feedback-controlled flow control valve in which a feedback mechanism accurately controls the discharge fluid flow therethrough regardless of the pressure of the fluid being controlled.

Pilot-operated control valve 106 is preferably of the type which requires the application of a substantial control hydraulic pressure on a hydraulic control line 110 in order to permit discharging hydraulic fluid from hydraulic cylinder 46. As indicated schematically in FIG. 3, pilot-operated control valve 106 contains a check valve 112 which, in the absence of hydraulic pressure on hydraulic control line 110, permits only unidirectional flow of hydraulic fluid from fluid supply and discharge line 102 to hydraulic cylinder 46 and prevents return flow. A valve release actuator 114 is effective to release check valve 112 and to permit the discharging of hydraulic fluid from hydraulic cylinder 46 when it receives a predetermined amount of hydraulic pressure on hydraulic control line 110. Discharged hydraulic fluid is delivered through short-lift jack control valve 96 and a discharge line 116 to a sump 118. As is conventional, the pressure on hydraulic control line 110 required to release check valve 112 must exceed a predetermined fraction of the pressure applied to check valve 112 from hydraulic cylinder 46. The pressure on hydraulic control line 110 required to release check valve 112 may be, for example, about 25 percent of the pressure from hydraulic cylinder 46. In order to insure that the control pressure on hydraulic control line 110, in the illustrated quiescent position of short-lift jack control valve 96 shown, remains well below the pressure reflected back from hydraulic cylinder 46, hydraulic control line 110 is normally vented to sump 118.

It will be clear from a review of FIG. 3 and the accompanying description that a supply of pressurized hydraulic fluid must be available to long-lift hydraulic jack 26 before short-lift hydraulic jack 34 can be either raised or lowered.

Having described specific preferred embodiments of the invention with reference to the accompanying drawings, it is to be understood that the invention is not limited to those precise embodiments and that various changes and modifications may be effected therein by one skilled in the art without departing from the scope or spirit of the invention as defined in the appended claims.

What is claimed is:

1. A double lift jack comprising:

a housing;

said housing including a base supportable on a surface and at least one rigid vertical member extending upward from said base;

a first hydraulic jack disposed on said base;

said first hydraulic jack including means responsive to an application of a first pressurized hydraulic fluid thereto for producing a first vertical urging;

a platant;

means for permitting a first vertical motion of said platant in response to said first vertical urging between a first vertical position and a second vertical position;

a second hydraulic jack disposed on said platant;

a load base mounted on said second hydraulic jack;

said second hydraulic jack including means responsive to an application of a second pressurized hydraulic fluid thereto for producing a second vertical urging;

means in said platant for permitting a second vertical motion of said load base in response to said second vertical urging; and means for rigidly mechanically affixing said platant to said at least one rigid vertical member in at least one of said first and second vertical positions whereby said platant is stabilized by said at least one rigid vertical member in said at least one of said first and second positions such that the precision and the stability of said second vertical motion is improved independently of the precision and stability of said first hydraulic jack.

2. A double lift jack according to claim 1 wherein said at least one rigid vertical member includes at least a plurality of sidewalls, said sidewalls surrounding said platant and forming a central opening therein, said central opening having a dimension sufficient to permit said load base to pass therethrough.

3. A double lift jack according to claim 1 wherein said means for rigidly affixing includes a lip on said at least one rigid vertical member, said lip extending horizontally over a horizontal extremity of said platant, at least one stud fixedly mounted in one of said lip and said platant, a hole in the other of said lip and said platant, said hole and said stud being mutually disposed to permit said stud to pass into and through said hole when said platant attains said at least one of said first and second vertical positions, and retaining means for engaging said stud.

4. A double lift jack according to claim 3 wherein said stud includes a threaded portion, and said retaining means further includes a nut engageable with said threaded portion, and tightenable against a first surface of said lip remote from a second surface against which said platant is urged.

5. A double lift jack according to claim 3 wherein said means in said housing for permitting vertical motion of said platant includes at least one vertical guide member effective for providing a vertical guidance to said platant, said vertical guidance being effective for guiding entry of said stud into said hole.

6. A double lift jack according to claim 1 wherein said means in said platant for permitting a second vertical motion includes at least one vertical guide hole in said platant and at least one vertical guide pin affixed to said load base, said at least one vertical guide pin passing guidingly through said at least one guide hole.

7. A double lift jack according to claim 1 wherein said platant includes at least one horizontally disposed plate and said means in said platant for permitting a second vertical motion includes a plurality of guide holes in said at least one horizontally disposed plate and an equal plurality of vertically disposed guide pins affixed to said load base passing guidingly through respective ones of said guide holes, a precision of a sliding fit between said plurality of guide pins and guide holes being effective to provide a stable vertical guidance of said load base.

8. A double lift jack according to claim 7 wherein said at least one horizontally disposed plate includes at least first and second vertically spaced apart horizontally disposed plates and said plurality of guide holes includes a first plurality of guide holes in said first horizontally disposed plate and a second plurality of guide holes in said second horizontally disposed plate, said first plurality of guide hole being respectively aligned with corresponding ones of said second plurality of guide holes and said plurality of guide pins each passing vertically through one of said first plurality of guide holes and one of said second plurality of guide holes.

9. A double lift jack system comprising:

a housing;

said housing including a base supportable on a surface and at least one rigid vertical member extending upward from said base;

a first hydraulic jack disposed on said base;

said first hydraulic jack including means responsive to an application of a first pressurized hydraulic fluid thereto for producing a first vertical urging;

a platant in said housing;

means in said housing for permitting a first vertical motion of said platant in response to said first vertical urging between a first vertical position and a second vertical position;

a second hydraulic jack disposed on said platant;

a load base mounted on said second hydraulic jack;

said second hydraulic jack including means responsive to an application of a second pressurized hydraulic fluid thereto for producing a second vertical urging;

means in said platant for permitting a second vertical motion of said load base in response to said second vertical urging;

means for rigidly mechanically affixing said platant to said at least one rigid vertical member in at least one of said first and second vertical positions whereby said platant is stabilized by said at least one rigid vertical member in said at least one of said first and second positions and the precision and stability of said second vertical motion is improved independently of the precision and stability of said first hydraulic jack; and a hydraulic control apparatus for controlling said application of said first pressurized hydraulic fluid and said second pressurized hydraulic fluid.

10. A double lift jack system according to claim 9 wherein said hydraulic control apparatus includes means for producing said first vertical urging whenever said second hydraulic jack is controlled in either vertical direction.

11. A double lift jack system according to claim 9 wherein said hydraulic control apparatus includes a first jack control valve, said first jack control valve including means for applying a supply of pressurized hydraulic fluid to said first hydraulic jack, said first hydraulic jack including means responsive to said supply of pressurized hydraulic fluid for urging said platant into mechanical abutment with said at least one rigid vertical member in a one of said first and second vertical positions permitting use of said means for rigidly mechanically affixing, a second jack control valve, means for applying said supply of pressurized hydraulic fluid to said second jack control valve, a pilot-operated control valve, said pilot operated control valve including first and second inlets and one outlet, said one outlet being connected to said second hydraulic jack, a first hydraulic line from a first outlet of said second jack control valve to said first inlet, a second hydraulic line from a second outlet of said second jack control valve to said second inlet, said pilot-operated control valve including means for permitting pressurized hydraulic fluid applied to its first inlet to pass to its outlet and for preventing hydraulic fluid from passing from said outlet to said first inlet, said pilot-operated control valve further including means responsive to a predetermined hydraulic fluid pressure at said second inlet for permitting a discharge of hydraulic fluid from said outlet to said first inlet, said second jack control valve including means for selectively applying said supply of pressurized fluid from said first jack control valve to said first and second hydraulic lines whereby said second hydraulic jack is operable in the extending or retracting direction only when said supply of pressurized hydraulic fluid is applied to said first hydraulic jack and said second hydraulic jack is otherwise inoperable and is locked in position.

* * * * *